US007350997B2

(12) United States Patent
Rousselet

(10) Patent No.: US 7,350,997 B2
(45) Date of Patent: Apr. 1, 2008

(54) PACKAGING AND APPLICATOR DEVICE FOR APPLYING A SUBSTANCE, IN PARTICULAR A COSMETIC

(75) Inventor: Guilhem Rousselet, Paris (FR)

(73) Assignee: L'Oreal, Paris (FR)

( * ) Notice: Subject to any disclaimer, the term of this patent is extended or adjusted under 35 U.S.C. 154(b) by 86 days.

(21) Appl. No.: 11/080,477

(22) Filed: Mar. 16, 2005

(65) Prior Publication Data

US 2005/0214058 A1 Sep. 29, 2005

Related U.S. Application Data

(60) Provisional application No. 60/560,275, filed on Apr. 8, 2004.

(30) Foreign Application Priority Data

Mar. 25, 2004 (FR) ..... 04 03099

(51) Int. Cl.
*A46B 11/00* (2006.01)
*A46B 17/08* (2006.01)
*A45D 33/00* (2006.01)

(52) U.S. Cl. ..... 401/126; 401/122; 401/129; 401/130

(58) Field of Classification Search ..... 401/121–130
See application file for complete search history.

(56) References Cited

U.S. PATENT DOCUMENTS 3,692,417 A * 9/1972 Aston ..... 401/122
3,921,650 A 11/1975 Montgomery
4,761,088 A 8/1988 Zubek
5,803,638 A 9/1998 Gueret
5,873,669 A * 2/1999 Poore et al. ..... 401/122

FOREIGN PATENT DOCUMENTS

| | | |
|---|---|---|
| EP | 0 740 913 A1 | 11/1996 |
| EP | 1 275 322 A1 | 1/2003 |
| FR | 2 646 066 | 10/1990 |
| FR | 2 697 506 | 5/1994 |
| FR | 2 824 244 | 11/2002 |
| FR | 2 831 033 | 4/2003 |
| WO | WO 94/14357 | 7/1994 |
| WO | WO 97/35499 | 10/1997 |

* cited by examiner

*Primary Examiner*—David J. Walczak
(74) *Attorney, Agent, or Firm*—Oliff & Berridge, PLC

(57) ABSTRACT

A device for applying a substance may include: a receptacle for containing the substance, the receptacle including an opening at a top end; a wiper member engaged in part in the opening and including a collar extending beyond the top end of the receptacle, the collar including an outer peripheral surface; and an applicator including:

an applicator element;

a handle; and a stem connecting the applicator element to the handle, the handle including a tubular mounting skirt configured to be fastened on the receptacle for closing the receptacle, the mounting skirt being monolithic with the stem, the mounting skirt coming into sealing contact with the peripheral surface of the collar when the receptacle and the applicator are in a closed position.

33 Claims, 3 Drawing Sheets

PACKAGING AND APPLICATOR DEVICE FOR APPLYING A SUBSTANCE, IN PARTICULAR A COSMETIC

This non provisional application claims the benefit of French Application No. 04 03099 filed on Mar. 25, 2004 and U.S. Provisional Application No. 60/560,275 filed on Apr. 8, 2004.

The present invention relates to packaging and applicator devices for applying a substance, in particular a cosmetic, e.g. mascara, nail varnish, or liquid lipstick.

The invention relates more particularly to a device comprising: a receptacle containing the substance; an applicator comprising an applicator element; a handle; a stem connecting the applicator element to the handle; and a wiper member configured to wipe the applicator element, at least in part, while said applicator element is being removed from the receptacle.

BACKGROUND OF THE INVENTION

In order to ensure that such a device is sealed, i.e. leaktight, when closed, it is known from European patent application EP 0 740 913, international application No. WO 94/14357, U.S. Pat. No. 4,761,088, or French patent application No. 2 646 066 to make the wiper member with a collar against which the handle comes to bear axially.

Application Nos. EP 1 275 322 and FR 2 831 033 describe other devices in which such axial bearing is sought.

French patent application No. 2 824 244 discloses a packaging and applicator device for mascara, the device having an applicator that comprises a handle and a stem that are made integrally as a single piece, the device being sealed when closed by means of the handle being in direct contact on the receptacle.

SUMMARY OF THE INVENTION

There exists a need to simplify the manufacture of the device without compromising its leaktightness when closed.

The invention satisfies this need by means of a packaging and applicator device for applying a substance, the device comprising:

- a receptacle for containing the substance, the receptacle presenting an opening at its top end;
- a wiper member engaged in part in the opening and comprising a collar extending beyond the top end of the receptacle, the collar having an outer peripheral surface; and
- an applicator comprising:
  - an applicator element;
  - a handle; and
  - a stem connecting the applicator element to the handle, the handle comprising a tubular mounting skirt configured to enable the applicator to be fastened on the receptacle, and to enable said receptacle to be closed, the mounting skirt and the stem being made integrally as a single piece, the mounting skirt coming into sealing contact with the peripheral surface of the collar when the receptacle and its applicator are in the closed position.

The mounting skirt may be connected to a transverse wall of the handle. The transverse wall may be situated remote from the collar of the wiper member when the receptacle and its applicator are in the closed position. The transverse wall may also define a top surface of the handle.

By means of the invention, it is possible to make at least the stem and the mounting skirt of the handle integrally as a single piece, e.g. by injection molding a plastics material, while ensuring that the device is sealed in satisfactory manner when closed. By way of example, the applicator element may be made integrally as a single piece with the stem and the handle during molding, or it may be added onto the stem after the stem and the handle have been molded.

The invention also makes it possible to make a handle of size that is sufficient to enable it to be held easily, e.g. of size comparable to the size of handles of known devices. By way of example, the handle can present a length that is at least equal to twice the length of the neck, when the receptacle comprises a neck.

Furthermore, the invention makes it possible to make the handle relatively long without spoiling the appearance of the handle. In particular, the handle can be made with a skirt-free top portion defining a housing that opens upwards when the device is disposed with the applicator element at the bottom.

Where appropriate, all three of the mounting skirt, the stem, and the applicator element may be made integrally as a single piece.

The receptacle may comprise a neck in which at least part of the wiper member is engaged.

In an advantageous embodiment, the collar comprises a rim covering at least part of the outside of the receptacle. The presence of such a rim can enable the wiper member to be held more securely on the receptacle, in particular on its neck. When a rim is provided, the outside top portion of the receptacle may present an annular setback configured to receive at least part of the rim of the collar.

In another embodiment, the collar does not have a rim covering at least part of the outside of the receptacle, in particular its neck.

Contact between the wiper member and the mounting skirt may optionally be made only at the peripheral surface of the collar.

Where appropriate, the peripheral surface may comprise at least one annular lip configured to be applied in sealed manner against the mounting skirt. By way of example, the collar may comprise two annular lips configured to be applied in sealed manner against the mounting skirt. In this case, the collar may comprise an annular groove between the two above-mentioned lips.

The collar may also present a rounded peripheral edge that is outwardly convex.

The mounting skirt may be configured to be screwed on the neck of the receptacle, snap-fastened on the receptacle, or fastened in still some other way, e.g. by friction, or by a fastener of the bayonet type.

The collar may present a maximum outside diameter that is not less than the outside diameter of the top end of the receptacle, so as to project outwards.

The mounting skirt may present an inside surface having at least a portion that comes into contact with the peripheral surface of the collar when the receptacle and its applicator are in the closed position, said portion presenting a diameter that is not greater than the maximum outside diameter of the collar.

The mounting skirt may present an inside surface having at least a portion, e.g. a substantially conical portion, diverging towards the receptacle and coming into contact with the wiper member. Such a portion can make it easier to put the handle in place on the receptacle, while ensuring that said receptacle is sealed when closed.

The mounting skirt may be configured in such a manner that clamping between the mounting skirt and the wiper member becomes tighter as the applicator is being fastened on the receptacle.

The wiper member can present a maximum outside radius that is at least 0.1 millimeters (mm) greater than the inside radius of a portion of the mounting skirt that comes into contact with the wiper member when the receptacle and said wiper member are in the closed position. The mounting skirt may press radially into the collar of the wiper member when the device is closed.

The inside surface of the mounting skirt may comprise a rib configured to come into contact with the peripheral surface of the collar when the applicator is in the closed position.

The stem may present a circular cross-section of substantially constant diameter.

The wiper member may comprise a wiper lip defining an orifice of section matching the section of the stem to be wiped, e.g. a circular orifice of diameter that is not greater than the diameter of the stem, so as to prevent substance from flowing into the handle when the device is closed.

The applicator element may be a brush, a comb, an endpiece, e.g. a foam endpiece, or a flocked endpiece, this list not being limiting.

The receptacle may contain a cosmetic such as mascara, nail varnish, or liquid lipstick, for example.

BRIEF DESCRIPTION OF THE DRAWINGS

The invention can be better understood on reading the following description of non-limiting embodiments thereof, and on examining the accompanying drawings, in which.

MORE DETAILED DESCRIPTION

Figure 1:
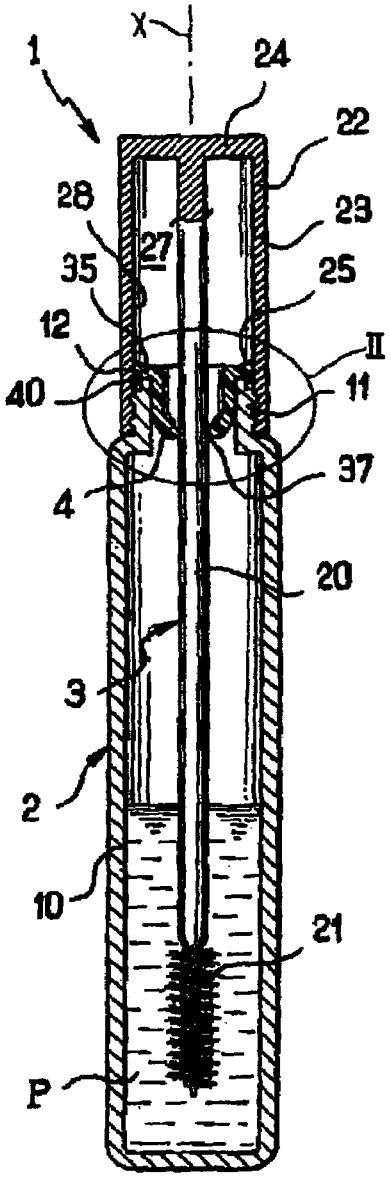
FIG. 1 is a diagrammatic axial-section view of a packaging and applicator device constituting an embodiment of the invention.

FIG. 1 shows a packaging and applicator device 1 for applying a substance P, e.g. a cosmetic such as mascara.

The device 1 comprises a receptacle 2, e.g. of elongate shape, an applicator 3, and a wiper member 4 permanently secured inside the receptacle 2.

The receptacle comprises a body 10 containing the substance P, and, in the example under consideration, is provided in its top portion with a neck 11 of axis X, said neck having an outside thread in the embodiment shown, and having a top end that defines an opening in which the wiper member 4 is engaged.

In the embodiment shown, the top end of the neck 11 presents an annular setback 57.

In the example under consideration, the applicator 3 comprises a stem 20 of section that is circular over substantially its entire length, the bottom end of said stem being provided with an applicator element 21 that is constituted by a brush having a twisted core in the embodiment shown. The top end of the stem 20 is connected to a handle 22 also constituting a closure cap for the receptacle 2.

The stem 20 and the handle 22 are made integrally as a single piece, e.g. by injection molding a plastics material, and onto which the applicator element 21 is then added.

By way of example, the wiper member 4 can be made of an elastomer material, or of a polyolefin, in particular polyethylene, or of any other plastics material.

The mounting skirt can be made of a polyolefin, in particular polypropylene, of polyoxymethylene (POM), or of any other plastics material.

The handle 22 comprises a tubular mounting skirt 23 having an outside surface that is substantially cylindrical over its entire height in the embodiment shown. The top of the mounting skirt 23 is connected to a transverse wall 24, which, in the example under consideration, extends substantially perpendicularly to the axis X so as to connect the stem 20 to the mounting skirt 23, and which defines a top surface of the handle. The handle has an inside thread suitable for screwing onto the neck 11.

In the embodiment shown, the transverse wall 24 is situated remote from the wiper member 4 when the receptacle 2 and its applicator 3 are in the closed position, as can be seen in FIG. 1.

Figure 2:
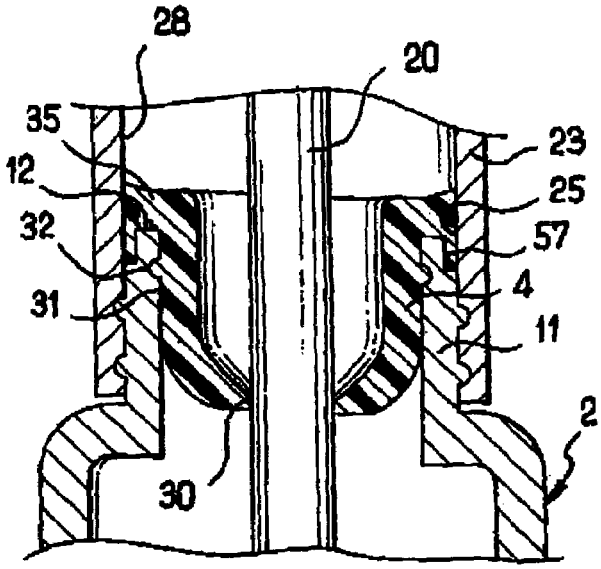
FIG. 2 is a larger-scale diagrammatic view of detail II in FIG. 1.
Figure 3:
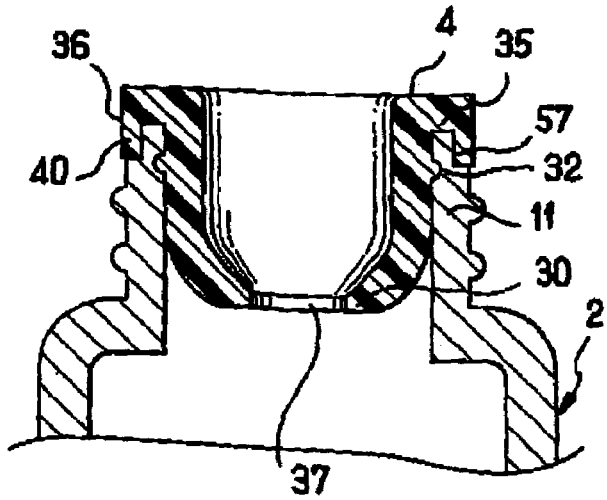
FIG. 3 is a view similar to FIG. 2, without the applicator.

Reference is made below to FIGS. 2 and 3, in which it can be seen that the bottom portion of the wiper member 4 comprises an annular wiper lip 30 defining an orifice 37 of circular section, the lip 30 being configured to bear against the stem 20 and/or the applicator element 21 while the applicator 3 is being removed from the receptacle. The diameter of the orifice 37 is preferably not greater than the diameter of the portion of the stem 20 that comes into contact therewith, so that when the device 1 is closed, substance P is prevented from escaping from the receptacle 2 into the space 27 defined around the stem 20 by the mounting skirt 23.

The wiper member 4 has a body 31 that bears against the inside surface of the neck 11. The body 31 can comprise retaining means for retaining it on the receptacle 2, the retaining means comprising, and as shown, a portion in relief, for example, such as an annular bead 32 configured to be received in a corresponding groove in the inside surface of the neck 11.

The top portion of the wiper member 4 comprises a collar 35 that bears against the top end 12 of the neck 11.

The outer periphery of the collar 35 presents a peripheral surface 36 against which there bears a corresponding portion 25 of the inside surface 28 of the mounting skirt 23.

The contact between the peripheral surface 36 of the collar 35 of the wiper member 4 and the portion 25 of the inside surface 28 makes it possible to ensure that the device is sealed when closed, i.e. when the applicator is in its storage position inside the receptacle.

In the embodiment shown in FIGS. 1 to 3, the collar 35 comprises a rim 40 that covers part of the outside of the neck 11, at least part of the rim 40 being received in the setback 57 of the neck 11.

By way of example, the diameter of the portion 25 can be slightly less than the outside diameter of the collar 35. Thus, when the device is in its closed position, the rim 40 is compressed radially a little, and can deform elastically, where appropriate.

Figure 4:
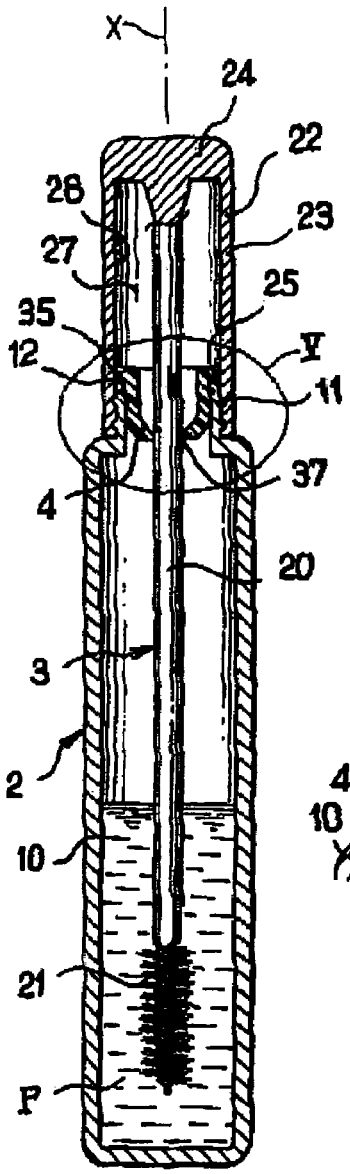
FIG. 4 is a view similar to FIG. 1, showing a variant embodiment of the invention.
Figure 5:
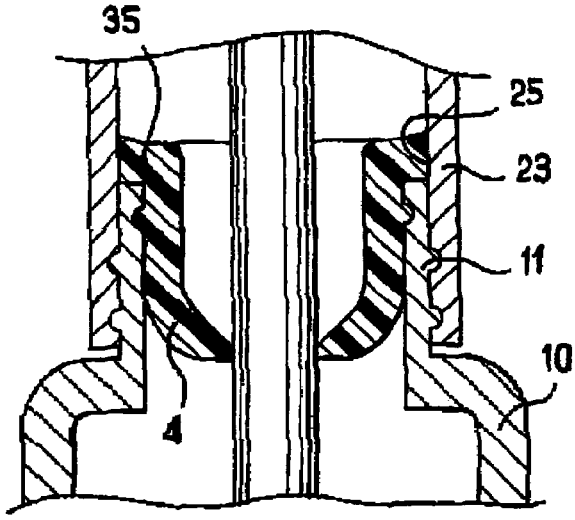
FIG. 5 is a larger-scale view of detail V in FIG. 4.
Figure 6:
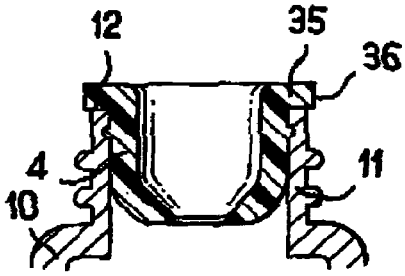
FIG. 6 is a view similar to FIG. 5, without the applicator.

In a variant, and as in the embodiment in FIGS. 4 to 6, the collar 35 need not comprise a rim 40.

It can be seen in FIG. 6 that the outside diameter of the collar 35 of the wiper member 4 can be slightly greater than the outside diameter of the neck 11.

Thus, when the peripheral surface 36 of the collar 35 is in contact with the portion 25 of the inside surface 28, so as to close the device in sealed manner, the collar 35 is compressed radially a little, as shown in FIG. 5.

The radially outside peripheral surface 36 can present various shapes.

Figure 7:
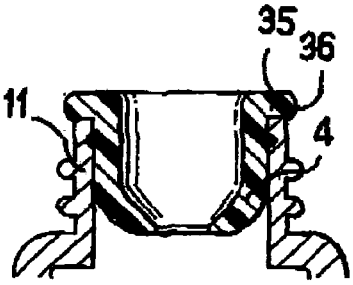
FIGS. 7 and 8 are views similar to FIG. 6 showing variant embodiments of the wiper member.

By way of example, FIG. 7 shows a wiper member 4 having a collar 35 that presents an outwardly-convex rounded edge defining the peripheral surface 36.

Figure 8:
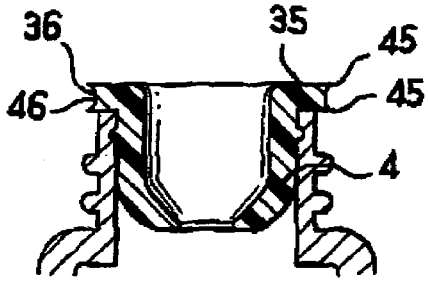

The collar 35 can comprise at least one sealing lip, or indeed two sealing lips, as shown in FIG. 8. In this figure, the peripheral surface 36 of the collar 35 is provided with two annular sealing lips 45 defining a groove 46 between them. The two sealing lips 45 come into contact with the portion 25 of the inside surface 28 of the mounting skirt 23, when the device is closed.

The handle 22 can present a different shape, without, however, going beyond the ambit of the present invention.

Figure 9:
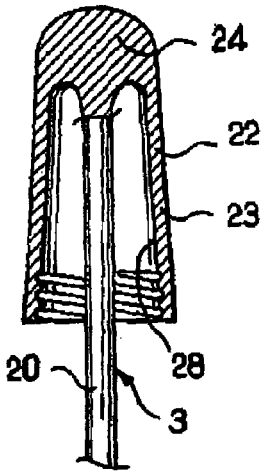
FIG. 9 is a diagrammatic and fragmentary axial-section view showing a variant of the handle.

By way of example, FIG. 9 shows a handle presenting a slightly frustoconical mounting skirt 23 diverging towards the receptacle so as to increase the clamping force exerted by the inside surface 28 of the mounting skirt 23 on the wiper member 4 as the handle 22 is screwed on the receptacle 2.

The wiper member 4 can present a maximum outside radius that is at least 0.1 mm greater than the inside radius of the portion of the mounting skirt that comes into contact with the wiper member.

The applicator 3 can be fastened on the receptacle 2 in a manner other than by screw-fastening.

Figure 10:
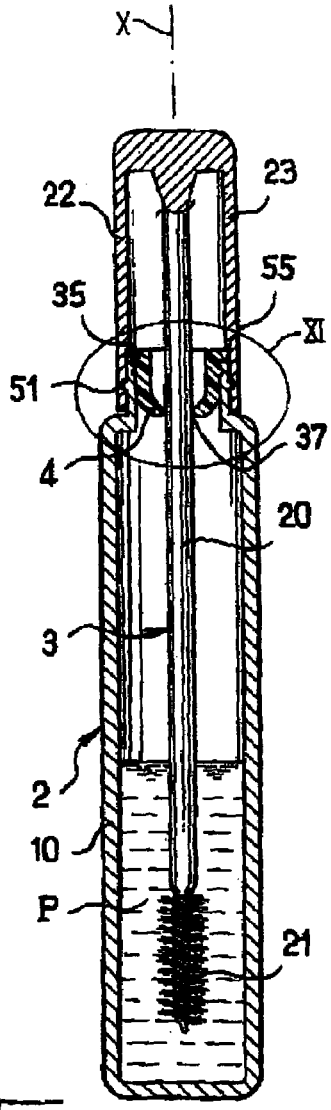
FIG. 10 is a diagrammatic and fragmentary axial-section view showing another embodiment of a device made in accordance with the invention.
Figure 11:
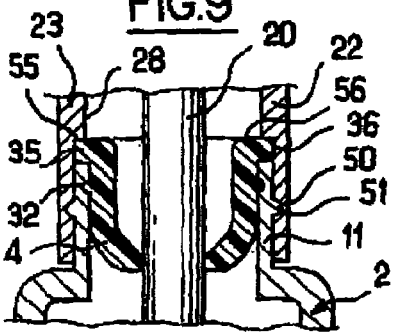
FIG. 11 is a larger-scale view of detail XI in FIG. 10.

For example, and as shown in FIGS. 10 and 11, the device can be closed by snap-fastening the handle 22 on the neck 11 of the receptacle, the inside surface of the mounting skirt 23 presenting an annular groove 50, and the neck 11 a corresponding flange 51, in the embodiment shown.

It can also be seen in FIGS. 10 and 11 that the mounting skirt 23 can present an annular shoulder 55 that comes to bear axially against a portion of the top surface 56 of the collar 35, when the device is closed.

In this embodiment, sealing is thus provided firstly by the contact between the inside surface 28 of the mounting skirt 23 and the peripheral surface 36 of the collar 35, and secondly by the contact between the shoulder 55 of the mounting skirt 23 and the top surface 56 of the collar 35.

Figure 12:
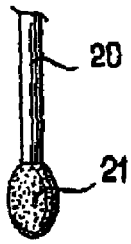
FIGS. 12 and 13 are diagrams showing other applicator elements.
Figure 13:
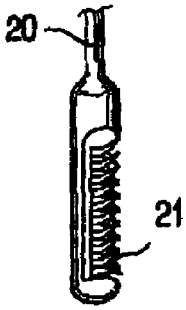

The applicator element 21 can be constituted by something other than a brush, and, in particular, by an endpiece which can optionally be flocked, and which can optionally comprise a piece of foam, as shown in FIG. 12, or by a comb, as shown in FIG. 13. By way of example, the comb can be made integrally as a single piece by being molded with the stem and the handle. It is not beyond the ambit of the present invention if the applicator comprises an applicator element that is different from the applicator elements described above, e.g. a paint brush.

Naturally, the invention is not limited to the embodiments described above. The receptacle or the handle can have still other shapes, for example.

Figure 14:
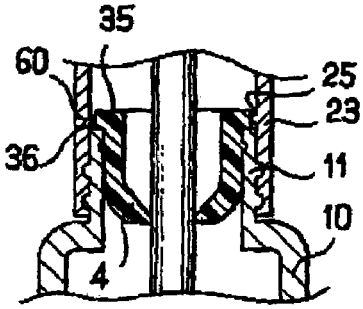
FIGS. 14 and 15 are diagrammatic and fragmentary axial-section views showing other variants of the device of the invention.

By way of example, and as shown in FIG. 14, it is also possible to provide, on the inside surface 28 of the mounting skirt 23, a portion in relief, e.g. an annular rib 60 configured to come into contact with the collar 35 of the wiper member when the device is closed. The portion in relief can bear against the peripheral surface 36, for example. In such an embodiment, the peripheral surface 36 can, for example, be set back from the radially outside surface of the neck 11, as shown.

Figure 15:
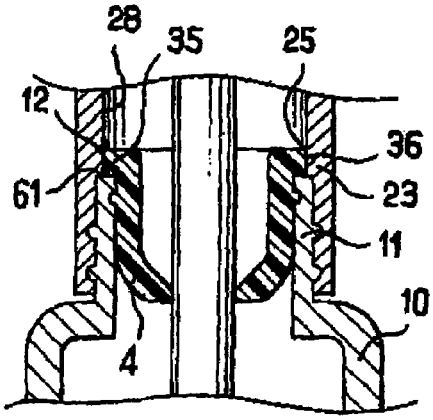

As shown in FIG. 15, it is also possible to make the inside surface 28 of the mounting skirt 23 with a shoulder 61 that comes to bear against the top end 12 of the neck 11. The portion 25 of the inside surface 28 comes into contact with the peripheral surface 36, it being possible, for example, for said peripheral surface to be set back from the radially outside surface of the neck 11, as shown.

Throughout the description, comprising in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A device for applying a substance, the device comprising:

a receptacle for containing the substance, the receptacle including an opening at a top end;

a wiper member engaged in part in the opening and comprising a collar extending beyond the top end of the receptacle, the collar including an outer peripheral surface; and an applicator comprising:

an applicator element;

a handle; and a stem connecting the applicator element to the handle, the handle comprising a tubular mounting skirt configured to be fastened on the receptacle for closing the receptacle, the mounting skirt being monolithic with the stem, the mounting skirt coming into sealing contact with the peripheral surface of the collar when the receptacle and the applicator are in a closed position, wherein the mounting skirt is connected to a transverse wall of the handle, the transverse wall connecting the stem to the mounting skirt and being situated remote from the collar of the wiper member when the receptacle and the applicator are in the closed position.

2. A device according to claim 1, wherein the transverse wall defines a top surface of the handle.

3. A device according to claim 1, wherein the receptacle comprises a neck in which at least part of the wiper member is engaged.

4. A device according to claim 3, wherein the mounting skirt is configured to be screwed on the neck of the receptacle.

5. A device according to claim 1, wherein the collar comprises a rim covering at least part of the outside of the receptacle.

6. A device according to claim 5, wherein an outside top portion of the receptacle comprises an annular setback configured to receive at least part of the rim of the collar.

7. A device according to claim 1, wherein the collar does not include a rim covering at least part of the outside of the receptacle.

8. A device according to claim 1, wherein contact between the wiper member and the handle is made only at the peripheral surface of the collar.

9. A device according to claim 1, wherein the peripheral surface defines at least one annular lip configured to be applied in a sealed manner against the mounting skirt.

10. A device according to claim 9, wherein the peripheral surface of the collar comprises two annular lips configured to be applied in a sealed manner against the mounting skirt.

11. A device according to claim 10, wherein the collar comprises a groove between the two annular lips.

12. A device according to claim 1, wherein the collar comprises a rounded peripheral edge.

13. A device according to claim 1, wherein the mounting skirt is configured to be snap-fastened on the receptacle.

14. A device according to claim 1, wherein the mounting skirt includes an inside surface having at least a portion that is substantially conical, diverging toward the receptacle and coming into contact with the wiper member when the receptacle and the applicator are in the closed position.

15. A device according to claim 1, wherein the mounting skirt is configured in such a manner that clamping between the mounting skirt and the wiper member becomes tighter as the applicator is being fastened on the receptacle.

16. A device according to claim 1, wherein the stem has a circular cross-section of substantially constant diameter.

17. A device according to claim 1, wherein the wiper member comprises an elastomer material.

18. A device according to claim 1, wherein the wiper member comprises a polyolefin.

19. A device according to claim 18, wherein the wiper member comprises polyethylene.

20. A device according to claim 1, wherein the mounting skirt comprises a polyolefin.

21. A device according to claim 20, wherein the mounting skirt comprises polypropylene.

22. A device according to claim 1, wherein the mounting skirt comprises polyoxymethylene.

23. A device according to claim 1, wherein the wiper member comprises a wiper lip defining a circular orifice of diameter matching a diameter of the stem to be wiped.

24. A device according to claim 23, wherein a diameter of the orifice defined by the wiper lip is not greater than a diameter of a portion of the stem that is in contact therewith when the device is closed.

25. A device according to claim 1, wherein the applicator element comprises a brush.

26. A device according to claim 1, wherein the applicator element comprises a comb.

27. A device according to claim 1, wherein the applicator element comprises a foam endpiece.

28. A device according to claim 1, wherein the receptacle contains a cosmetic.

29. A device according to claim 28, wherein the receptacle contains mascara.

30. A device according to claim 1, wherein an inside surface of the mounting skirt comprises a rib configured to come into contact with the outer peripheral surface of the collar when the applicator is in the closed position.

31. A device for applying a substrate, the device comprising:

a receptacle for containing the substance, the receptacle presenting an opening at a top end;

a wiper member engaged in part in the opening and comprising a collar extending beyond the top end of the receptacle, the collar having an outer peripheral surface; and an applicator comprising:

an applicator element;

a handle; and a stem connecting the applicator element to the handle, the handle comprising a tubular mounting skirt configured to be fastened on the receptacle for closing the receptacle, the mounting skirt being monolithic with the stem, the mounting skirt coming into sealing contact with the peripheral surface of the collar when the receptacle and the applicator are in a closed position, wherein the collar presents a maximum outside diameter that is greater than an outside diameter of the top end of the receptacle.

32. A device according to claim 31, wherein the mounting skirt includes an inside surface with at least a portion that comes into contact with the peripheral surface of the collar when the receptacle and the applicator are in the closed position, said portion including a diameter that is not greater than the maximum outside diameter of the collar.

33. A device for applying a substrate, the device comprising:

a receptacle for containing the substance, the receptacle presenting an opening at a top end;

a wiper member engaged in part in the opening and comprising a collar extending beyond the top end of the receptacle, the collar having an outer peripheral surface; and an applicator comprising:

an applicator element;

a handle; and a stem connecting the applicator element to the handle, the handle comprising a tubular mounting skirt configured to be fastened on the receptacle for closing the receptacle, the mounting skirt being monolithic with the stem, the mounting skirt coming into sealing contact with the peripheral surface of the collar when the receptacle and the applicator are in a closed position, wherein the wiper member presents a maximum outside radius that is at least 0.1 mm greater than an inside radius of a corresponding portion of the mounting skirt that comes into contact with the wiper member when the receptacle and the applicator are in the closed position.

* * * * *